United States Patent [19]

Alt et al.

[11] Patent Number: 4,621,528

[45] Date of Patent: Nov. 11, 1986

[54] MONITOR APPARATUS AND METHOD OF DETERMINING APPLIANCE SIZE

[75] Inventors: Vernon J. Alt, Janesville; Thomas J. Brogan, Rochester, both of Minn.

[73] Assignee: The Third Hand, Inc., Elysian, Minn.

[21] Appl. No.: 716,833

[22] Filed: Mar. 28, 1985

[51] Int. Cl.[4] ..... G01K 1/08

[52] U.S. Cl. ..... 73/432.1

[58] Field of Search ..... 73/432 R, 432 V, 432 G, 73/112, 5; 368/9; 374/1; 236/94; 165/11; 364/351, 556

[56] References Cited

U.S. PATENT DOCUMENTS

| | | | |
|---|---|---|---|
| 1,004,648 | 10/1911 | Hedley et al. | 368/9 |
| 1,475,831 | 11/1923 | Johnson et al. | 368/9 |
| 1,749,977 | 3/1930 | Hutches, Jr. | 368/9 |
| 1,909,116 | 5/1933 | Mylius et al. | 324/103 R |
| 2,003,016 | 5/1935 | Smith | 324/103 R |
| 2,333,758 | 11/1943 | Xenis et al. | 73/112 |
| 2,353,382 | 7/1944 | Barrett | 99/455 |
| 2,911,144 | 11/1959 | Lee et al. | 235/61 L |
| 3,019,658 | 2/1962 | Ehrhart | 73/432 R |
| 4,296,627 | 10/1981 | Lindstrom | 165/11 |
| 4,296,727 | 10/1981 | Bryan | 165/11 |
| 4,432,232 | 2/1984 | Brantley et al. | 73/432 R |

*Primary Examiner*—Stewart J. Levy
*Assistant Examiner*—Robert R. Raevis
*Attorney, Agent, or Firm*—Merchant, Gould, Smith, Edell, Welter & Schmidt

[57] ABSTRACT

Monitor apparatus and method for monitoring operation of an appliance to determine the proper size of the appliance with respect to energy output capability, the appliance having an on state wherein maximum energy output is provided and an off state wherein minimum energy output is provided. The monitor apparatus (20) includes a housing structure (26). First and second clock means (22, 24) are supported by the housing structure (26) for recording time. The first and second clock means (22, 24) are observable from the outside of the housing structure (26) so that the time recorded by the first and second clock means (22, 24) is readily observed. Power supply means (44, 46) is supported by the housing structure (26). Switch means (28) is mounted on the housing structure (26) switching the first clock means (22) on and off. The monitor apparatus (20) further includes means (50) for switching the second clock means (24) when the switch means (28) is in the on position and the appliance (40) is in the on state and for switching the second clock means (24) off when the appliance (40) is in the off state. Accordingly, the second clock means (24) records the total time that the appliance (40) is in the on state during the time that the monitor apparatus (20) is on as recorded by the first clock means (22).

8 Claims, 2 Drawing Figures

MONITOR APPARATUS AND METHOD OF DETERMINING APPLIANCE SIZE

BACKGROUND OF THE INVENTION

The present invention relates to an apparatus and method for determining proper appliance size. In particular, the present invention relates to an apparatus and method for determining appliance size wherein appliance on time and total time that the appliance is monitored are recorded.

Whenever a major appliance is purchased, substantial cost savings can be realized by buying an appliance sized such that its capacity is fully utilized at peak energy demand conditions. This is true whether the appliance be a gas furnace, an oil furnace, an electric furnace, an electric air conditioner, etc. While a preferred embodiment of the present invention is generally disclosed hereafter in terms of sizing gas furnaces, it will be appreciated that the present invention may be utilized with any number of different types of appliances. Further, in addition to other uses, the present invention can be used on an existing appliance to determine if the existing appliance's capacity is being fully utilized or is sufficient for peak demand. In addition, the present invention can be used to determine the proper size of a replacement appliance for the currently existing appliance. Proper sizing of an appliance reduces purchase, maintenance and energy costs, as well as conserves energy.

Recently, high efficiency furnaces such as pulse type furnaces have gained wide acceptance because of their relatively high efficiency. As a result, consumers are in increasing numbers replacing their conventional furnaces with a high efficiency type furnace. There is a tendency to install oversized furnaces, thereby impacting the savings in fuel and costs which would normally be achievable. Therefore, a simple, inexpensive and yet accurate apparatus and method is needed for sizing furnaces, particularly where an existing furnace is being replaced with a new furnace.

There has been a long history of heat loss and heat gain calculations. However, most of these are rather lengthy, complicated and at best, an educated guess as to the amount of equipment or furnace size necessary to offset the heat loss or heat gain of a building. Further, such calculations are consistently on the strong side, indicating equipment larger than needed. This leads to oversized equipment which does not produce the comfort required, and because of cycling losses and short inefficient burns, is expensive to operate. Short cycling will also contribute to shortened equipment life because of strain caused by starting and stopping.

The advent of the high efficiency furnace, recently introduced to the general public, has dramatically brought to light the fact that an oversized furnace is an expensive furnace to operate. As a result, crude methods of calculations have emerged. Many of these consist of recording actual BTUH input to heating equipment by referring to extremely cold periods. By taking the total energy input for a specified length of time, typically in days, and dividing the input by the number of days times 24 hours per day, a crude estimate of the heat requirement can be obtained. Because it is difficult to separate and allocate the amount of energy required by water heaters, dryers, cooking, etc. this method is often inaccurate and further doubted by potential furnace purchasers. Furthermore, it is rather inconvenient to conduct such monitoring activity during extremely cold weather. Additionally, such testing is often not possible during the warm summer months. Another significant factor often overlooked is the fact that during the day there is solar gain which provides for internal heat gain so as to falsify the actual energy requirements of the building.

The present invention solves these and many other problems.

SUMMARY OF THE INVENTION

The present invention relates to an apparatus for monitoring operation of an appliance to determine the proper appliance size with respect to energy output, the appliance having an on state wherein maximum energy output is provided and an off state wherein minimum energy output is provided. The apparatus includes a housing structure supporting first and second clock means for recording time. The first and second clock means are observable from the outside of the housing structure so that the time recorded by the first and second clock means can be observed by an observer. The apparatus further includes power supply means supported by the housing structure. Switch means switchable between at least first and second positions is mounted on the housing structure for switching the first clock means on and off, respectively, the first clock means recording time when switched on and not recording time when switched off. The apparatus further includes relay means for switching the second clock means on when the switch means is in the first position and the appliance is in the on state and for switching the second clock means off when the appliance is in the off state, the second clock means recording time when on and not recording time when off. Accordingly, the second clock means records the total time the appliance is in the on state during the time that the monitor apparatus or the first clock means is switched on.

The present invention further relates to a method of monitoring operation of an appliance to determine the proper appliance size with respect to energy output, the appliance having a temperature sensitive device for switching the appliance from an "on" state wherein maximum energy output is provided to an "off" state wherein minimum energy output is provided. The method comprises determining the rate of fuel input to the appliance when the appliance is in the on state. A monitor apparatus including first and second clock means for recording time is interconnected to the appliance. The monitor apparatus is next switched on, the first clock means recording the total time that the monitor apparatus is switched on, the second clock means recording the time that the appliance is in the on state while the monitor apparatus is switched on. Outdoor temperature is noted when the monitor apparatus is switched on. The setting of the temperature sensitive device, i.e. thermostat, regulating the appliance operation is also noted when the monitor apparatus is switched on. The monitor apparatus is switched off after a period of time. The outdoor temperature is noted when the monitor apparatus is switched off. From the information derived, the required appliance size with respect to energy output is calculated.

The present invention is particularly advantageous in that it is relatively inexpensive, easy to use and yet accurate. The present invention can be readily used by someone who is not skilled in the art of furnace sizing. In addition, the present invention requires minimal time to set up for operation and does not require constant monitoring. Most importantly, the end user or customer can assist in taking the actual readings.

It is anticipated that the present invention will be attached to the furnace and the energy input or rate of consumption, often measured by British Thermal Units per Hour (BTUH), determined by a representative of the utility company. The customer will then turn on the invention when he/she retires for the night, while noting the time and the thermostat setting. Upon rising, the customer will turn the invention off and note the time. In addition, it would be helpful if the customer would note the outdoor temperature both when turning the invention on and when shutting it off, although this information, as well as wind velocity, can be obtained from the local Weather Bureau. The invention can then be picked up at a convenient time by the utility company representative when the customer will be at home, so as to be able to ask any questions he/she might have.

The present invention measures the actual energy input under actual operating conditions. The results obtained are then used to determine the peak energy requirements at a design temperature (e.g. the coldest expected temperature). Moreover, it enables the customer to participate in the actual process of determining the proper furnace size. This facilitates or enhances customer reliance in the measurements derived.

Data obtained from the present invention can be correlated with other variables which have a direct relation to the data obtained. For example, a short burn time is indicative of a very low overall efficiency. In addition, the effect of wind velocity, solar gain, etc. can be calculated.

These and various other advantages and features of novelty which characterize the present invention are pointed out with particularity in the claims annexed hereto and forming a part hereof. However, for a better understanding of the invention, its advantages and objects attained by its use, referenced should be had to the drawings which form a further part hereof, and to the accompanying descriptive matter in which there is illustrated and described a preferred embodiment of the present invention.

BRIEF DESCRIPTION OF THE DRAWINGS

Referring now to the drawings, in which like reference numerals and letters indicate corresponding parts throughout the several views, FIG. 2 is a partial diagrammatic/schematic view of the embodiment illustrated in FIG. 1 interconnected to a valve of a furnace or the like.

DETAILED DESCRIPTION OF THE PREFERRED EMBODIMENT

Figure 1:
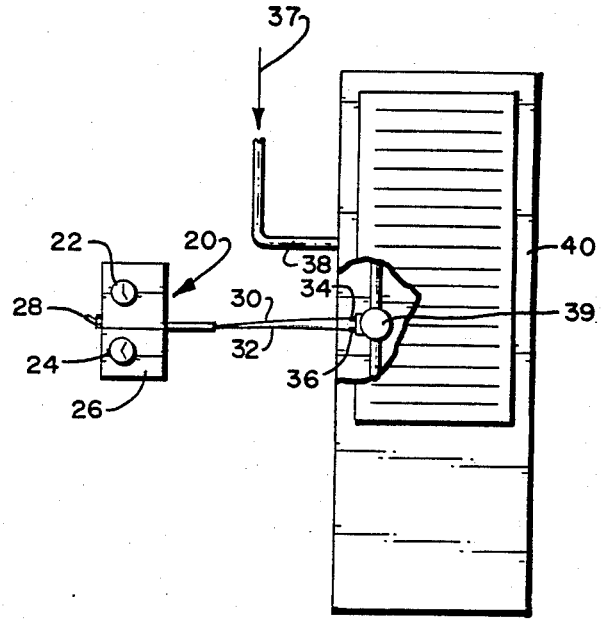
FIG. 1 is a diagrammatic view illustrating the connection of an embodiment of a monitor apparatus in accordance with the principles of the present invention to a furnace.
Figure 2:
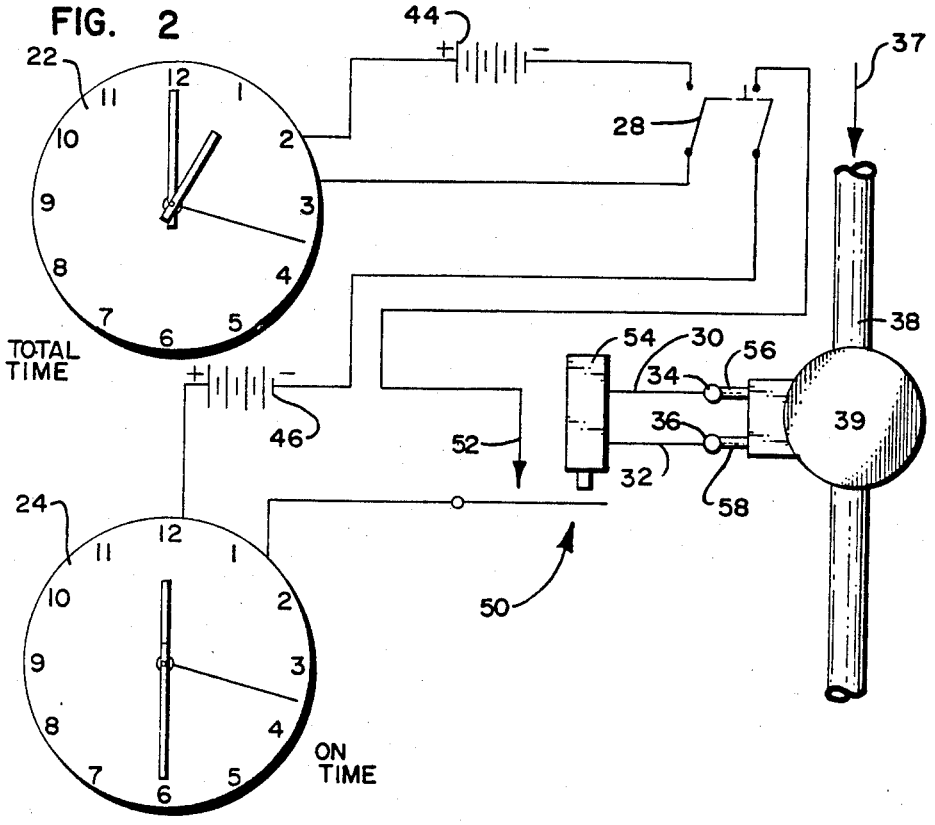

Illustrated in FIGS. 1 and 2 is a preferred embodiment of a monitor apparatus in accordance with the principles of the present invention, generally designated by the reference numeral 20. As illustrated in FIGS. 1 and 2, the monitor apparatus 20 includes two clocks 22, 24 or timekeeping devices mounted in a housing 26. As shown in FIG. 2, clock 22 is interconnected to a dual pole toggle switch 28 mounted on the outside of the housing 26 such that when the switch 28 is positioned in the "on" position, the clock 22 will be energized, thereby keeping track of the total time for which the monitor apparatus 20 is switched on. The monitor apparatus 20 is interconnected to a gas valve or heat relay 39 of an existing appliance, such as a furnace 40 by electrical leads 30, 32 interconnected to the 24 volt leads of the gas valve or heat relay 39 by suitable connectors 34, 36. It will be appreciated that the monitor apparatus 20 might be interconnected to any number of different appliances; for example, the monitor apparatus 20 might be interconnected to gas furnace valve leads, oil burner motor leads, air conditioner compressor contact leads, electric furnace contact leads, etc. As illustrated, the gas valve 39 is mounted in a gasline 38 and is activated to enable a supply of gas to the appliance as generally indicated by an arrow 37 and in particular, the furnace 40 whenever the furnace starts.

As indicated in FIG. 2, each of the clocks 22, 24 includes its own power supply in the form of a battery 44, 46, preferably 1.5 volt AA batteries. In the embodiment shown, the battery 44 is in series with the clock 22 and the dual pole switch 28. As further illustrated in FIG. 2, the monitor apparatus 20 includes a conventional relay 50 including a contact 52 and a coil 54. The relay 50 is interconnected to leads 56, 58 of the valve 39 such that when the valve 39 is activated the relay 50 is closed, thereby enabling operation of the clock 24 if the switch 28 is in the "on" position. In the embodiment shown, the battery 46 is in series with the clock 24, the dual pole switch 28, and the relay 50. Accordingly, the clock 24 keeps track of the total time the burner of the furnace 40 or other appliance is on during the time the monitor apparatus 20 is switched on by the switch 28.

In operation, the electrical leads 30, 32 are connected to the gas valve or heat relay 39 of the furnace or existing appliance 40. The furnace or appliance 40 is allowed to cycle on naturally. When the furnace 40 starts, it is allowed to run and after a predetermined period of time, preferably after six minutes, the utility meter is clocked to determine the BTUH input rate to the furnace 40. When the furnace 40 completes its first natural cycle, the on time is noted for later reference when determining probable efficiency of the furnace. The clocks 22, 24 on the monitor apparatus 20 are reset to twelve o'clock, the monitor apparatus including a reset capability even though this is not shown in the drawings. Preferably, the reset feature for resetting the clocks 22, 24 is accomplished by removing the back of the housing 26 and manually setting the hands of the clocks 22, 24 to the twelve o'clock position. This approach is preferred to prevent the end user from tampering with the clocks 22, 24. Preferably, these steps are accomplished by the utility company representative. The purchaser or customer is then instructed to switch on the monitor apparatus 20 by use of the switch 28 when he/she retires while noting the time and outdoor temperature. The customer is then instructed to switch the monitor apparatus off upon rising and again note the time and outdoor temperature. Further, the customer is instructed to note the temperature sensitive device or thermostat setting for the night.

The results obtained by the monitor apparatus 20 are next utilized to determine appliance size requirements in terms of its energy output capacity. First, the British Thermal Units per Hour (BTUH) input to the appliance when the appliance is on is calculated as follows:

$$\frac{K \times 3600 \times Z}{\text{SECS/REV}} = \text{BTUH Input}$$

where:

K=the cubic feet of gas input to the appliance per revolution of the meter dial;

Z=the British Thermal Units (BTU) content of one cubic foot or one gallon of the fuel, depending on whether gas or liquid, input from the meter;

SECS/REV=the seconds required to complete one revolution of the meter dial;

3600=the number of seconds in one hour; and

BTUH Input=the British Thermal Units per Hour (BTUH) input to the appliance when the appliance is on.

The K value is usually indicated on the meter, or can be obtained from the utility company. The Z value of the fuel can be looked up in an appropriate reference manual. Some typical Z values are as follows:

Natural Gas=1,000 BTU per cubic foot

Liquid Propane Gas (LPG)=2,500 BTU per cubic foot

Liquid Propane Gas=91,500 BTU per gallon

No. 1 Fuel Oil=138,000 BTU per gallon

The SECS/REV value is determined by monitoring the meter dial while the appliance is continuously in the "on" state. This is typically done prior to commencing the monitoring period with the monitor apparatus 20.

Next, the average BTUH input to the appliance over the duration of the test is calculated as follows:

$$\frac{\text{BTUH Input} \times \text{Hours Appliance On}}{\text{Total Hours of Test}} = \text{Average BTUH Input}$$

The hours the appliance is "on" is obtained from the clock 24, while the total hours of the test is determined by the clock 22.

Next, the actual average BTUH required during the duration of the test under test conditions is determined as follows:

$$\text{Average BTUH Input} \times \text{EF} = \text{Actual Average BTUH Input}$$

Where:

EF=the efficiency factor of the appliance being monitored.

There are commonly accepted efficiency factors for various types and ages of appliances. The efficiency factor can usually be readily obtained from the operating manuals or from the manufacturer. If not available, the efficiency factor can be determined by using a commonly accepted test for efficiency, such as the Backarach test. It is not uncommon for furnaces which are over 10 years old to have an efficiency factor of roughly 55%.

The next step is to determine the BTUH required at an arbitrary design outdoor temperature, wherein maximum output from the appliance is required. For example, a furnace in the northern part of the United States might be designed for 28 degrees below zero. It will be appreciated that the design temperature will vary depending on the geographic location. In addition, a design wind velocity will also be taken into consideration, particularly when monitoring such appliances as furnaces. The BTUH required at the design temperature and wind velocity is calculated as follows:

$$\frac{\text{Actual Average BTUH Input}}{TAF} \times WM = \text{Design BTUH}$$

Where:

TAF=Temperature Adjustment Factor

WM=Wind Multiplier

Design BTUH=the BTUH required at the design outdoor temperature and wind velocity The temperature adjustment factor is the temperature differential between the thermostat setting (inside temperature) and the average outside temperature during the test, divided by the temperature differential between the thermostat setting (inside temperature) and the outside design temperature. The average outdoor temperature might be determined by calling the Weather Bureau and getting a temperature readout for each hour over the duration of the test and taking an average of the hourly temperatures. For example:

Where: Inside Temperature=72 degrees

Test Outside Temperature=−3 degrees

Design Outside Temperature=−28 degrees $$TAF = \frac{75}{100} = \frac{3}{4}$$

The wind multiplier takes into consideration the effect of the wind on the energy output requirements of the appliance. It will be appreciated that for some appliances, the wind will not be a major factor and need not be taken into consideration. A maximum designed wind velocity is selected based on Weather Bureau records. For example, a maximum wind velocity of 30 miler per hour (mph) might be utilized in northern latitudes. The actual wind velocities during the test can be obtained from the local Weather Bureau based on when the test was started and stopped. An average wind velocity over the test period can then be determined or approximated. The wind multiplier is determined by first determining the approximate "U" factor of the structure wherein the appliance is located. The "U" factor is the amount of BTUH which one square foot will lose per degree of temperature difference. The "U" factor for a structure is approximated as follows:

$$\frac{\text{Estimated BTUH Heat Loss}}{\text{SQ. FT.} \times \text{Design Temp. Diff.}} = U$$

Where:

Estimated BTUH Heat Loss is typically chosen to be somewhat larger than the actual average BTUH adjusted to the design temperature SQ. FT.=the square footage of the structure exposed Design Temp. Diff.=the difference between the inside temperature and the design outside temperature.

The estimated BTUH Heat Loss is typically chosen to be somewhat larger than the actual average BTUH divided by the temperature adjustment factor. The inventors have found that this provides a fairly accurate estimate of the "U" factor for the structure. Thus, to determine the approximate "U" factor of a structure, the apparent heat loss of the structure is projected to a design temperature differential using the monitor apparatus 20. This quantity is then divided by the square footage of the exposed surface to give the heat loss per square foot of the exposed surface. Dividing the result by the design temperature differential; for example, 100 degrees or the difference between 72 degrees inside temperature and −28 degrees outside temperature, will give the effective "U" factor at whatever wind temperature prevailed at the time of the test. It will be appreciated that the wind velocity will have an effect on the "U" factor; the greater the "U" factor the greater the effect of the wind. The effect of wind on the "U" factor is commonly known. For example, a chart on the wind effects of "U" factors can be obtained from the American Society of Heating, Refrigeration and Air Conditioning Engineers (ASHRAE).

In order to determine the wind multiplier (WM), the "U" factor at the design wind velocity; for example, 30 mph, is divided by the "U" factor at the test wind velocity to derive the wind multiplier.

Once the design BTUH is determined, the proper appliance size can be determined by dividing the design BTUH by the efficiency of the replacement appliance.

It will be appreciated that the test results can be skewed somewhat by other appliances being utilized during the test period. However, performing the test during the night hours, particularly in the case of furnaces, substantially eliminates this problem. However, should this be a concern, the test results can be adjusted by any heat gain from the other appliances.

In the case of an electrical appliance, such as an electric furnace, the following equation can be utilized to determine the BTUH input from the electric utility meter:

$$\frac{Kh \times 3600 \times 3.413}{\text{SECS/REV}}$$

Where:

Kh = watts per revolution of the meter dial

3600 = seconds per hours 3.413 = the BTU value of one watt

SECS/REV = seconds to complete one revolution of the utility meter dial

In particular, this equation might be utilized when monitoring an air conditioner.

Adjustments due to heat gain from solar energy will need to be made only if testing is done from sunrise through sunset. By monitoring the appliance during the night hours, the effect of solar heating is negated.

It will be appreciated that in determining the wind adjustment factor, the wind chill factor might be utilized as an alternate approximation. However, this is not a preferred approach since wind chill is affected by moisture on a person's skin and therefore is less accurate for building structures.

It is to be understood, however, that even though numerous characteristics and advantages of the invention have been set forth in the foregoing description, together with details of the structure and function of the invention, the disclosure is illustrative only, and changes may be made in detail, especially in matters of shape, size and arrangement of parts within the principles of the invention, to the full extent indicated by the broad general meaning of the terms in which the appended claims are expressed.

What is claimed is:

1. An apparatus for monitoring an appliance, to determine proper appliance size with respect to energy output, the appliance having an on state wherein maximum energy output is provided and an off state wherein minimum energy output is provided, the apparatus comprising:

(a) a portable housing structure;

(b) first and second clock means supported by the housing structure for recording time, the first and second clock means each including indicator means observable from the outside of the housing structure for indicating the time recorded by the first and second clock means;

(c) power supply means electrically connected to the first and second clock means;

(d) switch means electrically connected to the first clock means and mounted on an outside of the housing, the switch means switchable at least between first and second positions for switching the first clock means between an on state and an off state, respectively, the first clock means recording time when in the on state; and (e) relay means operatively interconnected to the switch means and operatively interconnectable to the appliance for switching the second clock means to an on state when the switch means is in the first position and the appliance is in the on state and for switching the second clock means to an off state when the appliance is in the off state, the second clock means recording time when it is in the on state.

2. An apparatus in accordance with claim 1, wherein the switch means is interconnected in series with the first clock means and the power supply means, the switch means electrically connecting the first clock means to the power supply means when in the first position and electrically disconnecting the first clock means from the power supply means when in the second position.

3. An apparatus in accordance with claim 2, wherein the relay means is operatively interconnectable to the appliance so as to be electrically connected in series with the power supply means and the second clock means, the relay means being operatively interconnected to the appliance so as to electrically connect the second clock means to the power supply means when the appliance is in the on state and the switch means is in the first position and electrically disconnect the second clock means from the power supply means when the appliance is in the off state.

4. An apparatus in accordance with claim 3, wherein the switch means includes a dual-pole switch and the power supply means includes first and second DC batteries, the dual pole switch interconnecting the first DC battery to the first clock means when in the first position, the second DC battery being interconnected to the second clock means when the switch means is in the first position and the appliance is in the on state.

5. An apparatus in accordance with claim 4, wherein the relay means is electrically interconnected to electrical contacts of the appliance, the appliance providing a current at the electrical contacts when in the on state whereby the relay means is closed thereby interconnecting the second DC battery to the second clock means when the switch means is in the first position.

6. An apparatus for monitoring furnace operation to determine proper furnace size with respect to heating capacity, the furnace having a temperature sensitive device for switching the furnace between an on state wherein maximum heat output is provided and an off state wherein minimum heat output is provided, the apparatus comprising:

(a) a portable housing structure;

(b) first and second clock means supported by the housing structure for recording time, the first and second clock means each including indicator means observable from the outside of the housing structure for indicating the time recorded by the first and second clock means;

(c) power supply means electrically connected to the first and second clock means;

(d) switch means mounted on the outside of the housing structure and switchable between first and second positions for switching the first clock means on and off, respectively, the switch means interconnecting the first clock means to the power supply means when in the first position and disconnecting the first clock means from the power supply means when in the second position, the first clock means recording time when switched on;

(e) relay means operatively interconnected to the switch means and supported by the housing structure; and (f) interconnecting means for operatively interconnecting the relay means to the furnace, the relay means having first and second states, the relay means cooperating with the switch means for switching the second clock means on by interconnecting the second clock means to the power supply means when the relay means is in the first state and the switch means is in the first position, the relay means being electrically interconnected to the furnace so as to be placed in the first state when the furnace is in the on state, the second clock means recording time when switched on.

7. Method of monitoring operation of an appliance to determine proper appliance size with respect to energy output, the appliance having an on state wherein maximum energy output is provided and an off state wherein minimum energy output is provided, the method comprising the steps of:

(a) determining the rate of fuel input to the appliance when in the on state;

(b) interconnecting a monitor apparatus including first and second clock means to the appliance;

(c) switching on the monitor apparatus, the first clock means recording the total time the monitor apparatus is switched on, the second clock means recording the time the appliance is in the on state while the monitor apparatus is switched on;

(d) determining the time when the monitor apparatus is switched on;

(e) determining a thermostat setting on the appliance;

(f) switching off the monitor apparatus; and (g) calculating the appliance size required based on the information derived from the previous steps.

8. A method in accordance with claim 7, wherein the step of calculating the appliance size required includes the steps of:

(a) determining the rate of energy input to the appliance when the appliance is in the on state;

(b) determining the average rate of energy input throughout the total time the monitor apparatus is switched on;

(c) determining the actual average rate of energy input throughout the total time the monitor apparatus is switched on by multiplying the average rate of energy input by the efficiency factor of the appliance; and (d) determining the actual average rate of energy input required at a peak demand energy condition by dividing the actual average rate of energy input by a temperature adjustment factor, being the difference between the indoor temperature and the average outdoor temperature throughout the total time the monitor apparatus is switched on, divided by the difference between the indoor temperature and a selected outdoor temperature representative of the peak energy demand condition.

* * * * *